US006986449B2

(12) United States Patent
Strååt et al.

(10) Patent No.: US 6,986,449 B2
(45) Date of Patent: Jan. 17, 2006

(54) STAPLE-FORMER IN A STAPLER

(75) Inventors: Olle Strååt, Hestra (SE); Marcus Borjesson, Hestra (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 10/065,048

(22) Filed: Sep. 13, 2002

(65) Prior Publication Data

US 2003/0052151 A1 Mar. 20, 2003

(30) Foreign Application Priority Data

Sep. 14, 2001 (SE) ..... 0103048

(51) Int. Cl.
*B25C 5/16* (2006.01)

(52) U.S. Cl. ..... 227/87; 227/82; 227/88; 227/155

(58) Field of Classification Search ..... 227/82, 227/88, 91, 85, 56, 87, 154, 155
See application file for complete search history.

(56) References Cited

U.S. PATENT DOCUMENTS 1,748,261 A * 2/1930 Walker et al. ..... 227/88
2,185,518 A * 1/1940 Posnack ..... 29/432.1
3,524,575 A * 8/1970 Hurkmans et al. ..... 227/7
4,366,924 A * 1/1983 Leiter ..... 227/155
4,558,391 A * 12/1985 Ward et al. ..... 361/155
4,570,841 A * 2/1986 Olesen ..... 227/95
4,573,625 A * 3/1986 Olesen et al. ..... 227/131
4,623,082 A * 11/1986 Kurosawa ..... 227/7
5,121,868 A * 6/1992 Jairam ..... 227/123
5,147,080 A * 9/1992 Assink et al. ..... 227/82
5,273,199 A * 12/1993 Logtens ..... 227/87
5,794,833 A * 8/1998 Str.ang..ang.t ..... 227/137
5,996,876 A * 12/1999 Dickhoff et al. ..... 227/85
6,637,635 B2 * 10/2003 Borjesson et al. ..... 227/155

* cited by examiner

*Primary Examiner*—Scott A. Smith
(74) *Attorney, Agent, or Firm*—Howrey LLP

(57) ABSTRACT

A staple-former (11) in a stapler (1) that uses a driver blade (10) to drive staples (17), preferably into a sheaf of paper (16). The stapler contains a magazine (7) of staple blanks (8). A feed device (6) advances staple blanks onto an integral bending die (15) for bending into staple shape. Each staple has a first and a second leg (18, 19) and a crown portion (20). The staple-former (11) includes first and second leg-bending parts (24, 26) and crown-forming part (28). A staple forms when a drive device (12, 13, 14), moves the leg-bending parts (24, 26) and the crown-forming part over the bending die (15) causing a staple blank (8) to assume a staple shape. The staple-former then reciprocates to its starting positions, the staple advances to the driver blade (10), and a biasing element (32) urges the crown-forming part (28) away from the staple-former (11).

20 Claims, 5 Drawing Sheets

STAPLE-FORMER IN A STAPLER

CROSS REFERENCE TO RELATED APPLICATIONS

The present application claims priority to Swedish Patent Application No. 0103048-5 filed 14 Sep. 2001. Said application is expressly incorporated herein by reference in its entirety.

BACKGROUND OF INVENTION

1. Technical Field

The present invention relates to a staple-former in a stapler in which staples are driven by a driver blade into a workpiece, preferably a sheaf of paper. The stapler contains a staple magazine in which longitudinally extended staple blanks are stored. The staple blanks are advanced onto an integral bending die by a feed device contained in the stapler. The bending die has an upper support surface over which the staple blanks are bent by a staple-former into staple shape. This staple shape includes a first and a second leg with an intermediate crown portion. The staple-former has a first leg-bending part and a second leg-bending part with an intermediate crown-forming part that exhibits a stamping surface. The formation of a staple is accomplished by the staple-former being driven by a drive device that is integrated into the stapler from an starting position in a staple-forming motion in a direction that is transverse to the direction of extent of the support surface. During this motion, the staple-former is brought against the bending die, whereupon the leg-bending parts over the bending die bend the staple blank into a staple shape. In a continuation of this motion, the staple-former is advanced a distance such that the stamping surface of the crown-forming part presses the crown portion of the staple blank against the support surface. After this, the staple-former is reciprocated by the drive device back the starting position and the bent staple that has been formed is fed forward to the driver blade.

2. Background of the Invention

Staple-formers of the type described above are generally known. Such a staple-former is exemplarily described in the Swedish patent application SE 9201230-1. A disadvantage of earlier staple-formers is that they require extremely precise regulation of the staple-forming motion, since it is very important that the staple-former undergo reciprocation within an extremely narrow tolerance range. If reciprocation occurs too early, the crown-forming part will not press the staple crown against the bending die, and the staple blank will not be bent sufficiently and this often causes the stapler to jam. If reciprocation occurs too late, the crown-forming part will strike the bending die with great force, which damages the staple while at the same time causing the staple-former and drive device to wear much more rapidly. To counteract the aforesaid disadvantages, solutions have previously been proposed in which the stapler is equipped with damping devices that damp the staple-forming motion before reciprocation occurs. These devices are often complicated and expensive to fabricate, and they fail to solve the problems that arise when reciprocation occurs too early.

Another disadvantage of existing staple-formers is that, since they are usually driven by the same drive device that drives the driver blade, the staple-former must be adjusted precisely in relation to the driver blade, which can often be an extremely difficult task to perform.

The present invention overcomes these disadvantages by means of a staple-former of a type in which the crown-forming part is displaceably connected to the staple-former by means of an intermediate biasing means, also referred to as an elastic element and/or a take-up device or means. In a preferred embodiment, the elastic element takes the form of a leaf spring bent into a hairpin shape. Further in this preferred embodiment, the crown-forming part is displaceably connected to the staple-former by means of a guide arrangement. Still further, the staple-former exhibits an integrated driver blade. The biasing means or elastic element is configured or selected so that the biasing force exerted thereby is sufficiently high to maintain the crown-forming part in an extended position through out the bending of a staple blank over the bending die, but also sufficiently weak to permit the crown-forming part to retract into the body of the staple-former when the staple bending process has been completed, but the staple-former continues to be driven toward the bending die.

BRIEF DESCRIPTION OF DRAWINGS

The invention will be described below with reference to the accompanying figures, in which.

DETAILED DESCRIPTION

Figure 1:
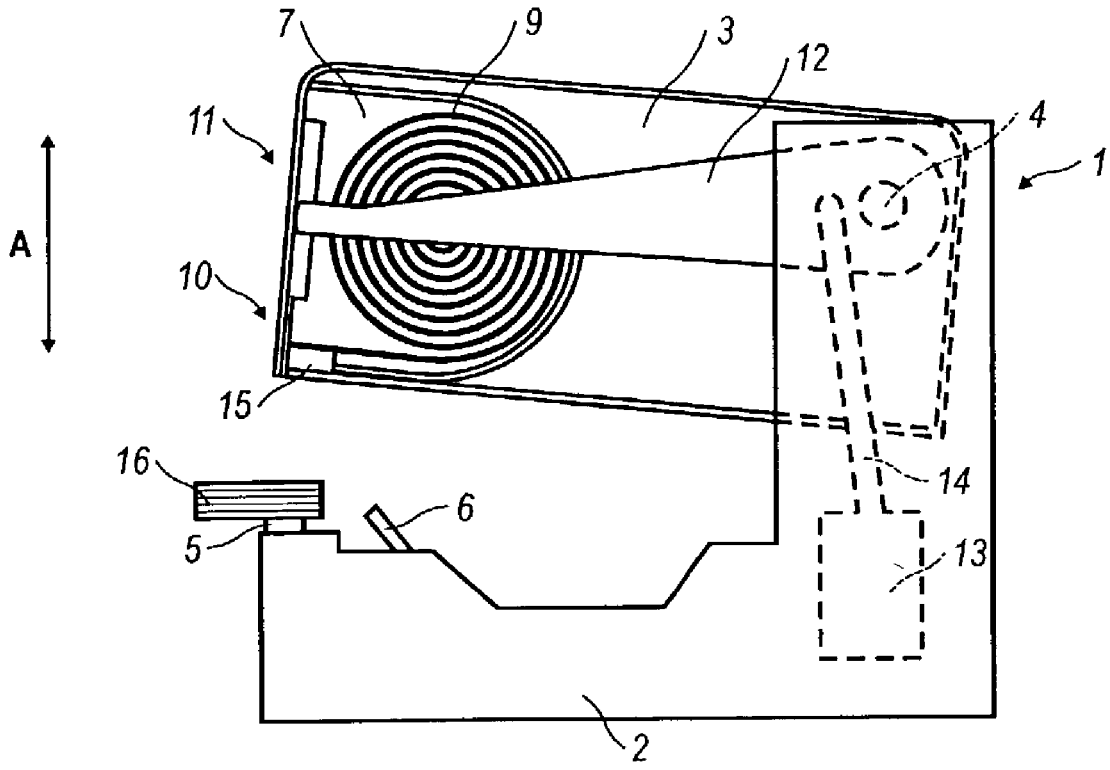
FIG. 1 is a schematic view, shown in partial cut-away, of a stapler according to the present invention.

A preferred embodiment of the invention will hereinafter be described with reference to the accompanying drawings. In that regard, FIG. 1 shows a stapler arrangement 1 that includes a base part 2 to which a stapler head 3 is pivotably connected by means of a pivot shaft 4. The base part 2 is equipped with a staple anvil 5 and a feed device 6. A staple magazine 7 is arranged in the stapler head 3 and contains longitudinally extended staple blanks 8 whose long sides are joined to one another to form an extended band that is arranged into a roll shape 9 in the illustrated embodiment. In the stapler head there is arranged a driver blade 10, which is integrated with a staple-former 11, also referred to as a staple forming arrangement 11.

The staple-former 11 is interconnected with drive arms 12, but only one of which is shown in FIG. 1. With regard to the descriptions contained herein, the terminology interconnected should be taken to indicate that a connection exists between the so-described elements, but that connection may be direct or indirect; that is, there may be other components or elements interstitially positioned along the connection that is so described. The drive arms 12 are pivotably mounted in bearings on the pivot shaft 4. A drive motor 13 is arranged on the base part 2 that is connected to the drive arms 12 by means of a transmission device 14. In the stapler head 3, a bending die 15 is arranged over which the staple blanks 8 are bent by the staple-former 11 into staple shape in a manner that will be clarified in the description below. FIG. 1 also shows a workpiece 16 that is to be stapled, and which preferably consists of a sheaf of papers. The drive arms 12, drive motor 13 and transmission device 14 form a drive element which, in a manner that is known, drives the stapler head 3, the driver blade 10 and the staple-former 11 in an up-and-down stapling motion that is identified by the double headed arrow A.

Figure 2:
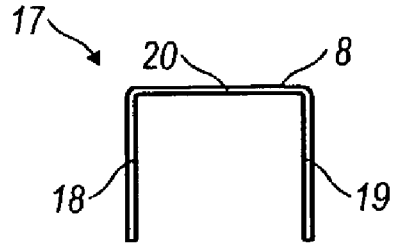
FIG. 2 is an elevational view of a staple blank bent into staple shape.

FIG. 2 shows a staple blank 8 that is bent into staple shape 17, which shape exhibits a first leg 18 and a second leg 19 which are substantially parallel, and has an intermediate crown portion 20.

Figure 3:
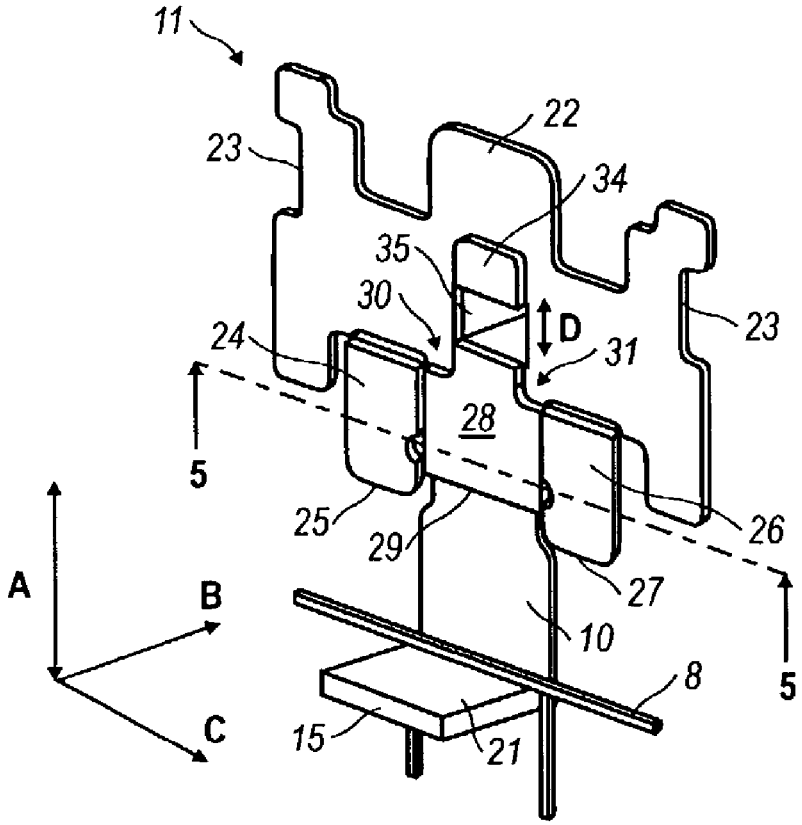
FIG. 3 is a perspective view showing the staple-former and bending die of the invention, and on which an unbent staple blank is placed.
Figure 4:
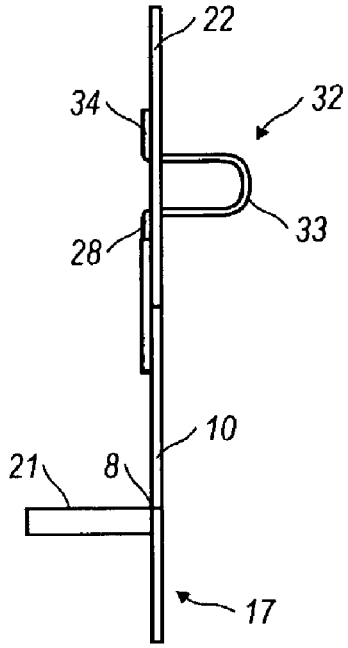
FIG. 4 is a side elevational view corresponding to FIG. 3.

FIGS. 3 and 4 depict in detail the staple-former 11, the bending die 15 with a staple blank 8 placed thereon, and the driver blade 10. The bending die 15 exhibits an upper support surface 21, whose direction of extension is indicated by the arrows B and C. The direction of motion of the staple-former is also indicated in this figure by a double arrow A and, as can be seen, this direction of motion is transverse to the direction of extension of the support surface B, C. The staple-former 11 comprises a plate-shaped base part 22 that has recesses 23 for the drive arms 12, but which are not shown in this Figure. The staple-former 11 further exhibits a first leg-bending pan 24, which is integrated with the base part 22 and exhibits a bending surface 25, and a second leg-bending part 26, which is also integrated with the base part 22 and exhibits a bending surface 27. The base part 22, also referred to as a main body portion 22 of the staple forming device 11, exhibits a driver blade 10 which, as is mostly clearly seen in FIG. 4, constitutes an integral part of the base part 22 of the staple-former 11. Between the leg-bending parts or portions 24 and 26 there is arranged a crown-forming part or portion 28 that exhibits a stamping surface 29 facing the bending die. The crown-forming part 28 is displaceably connected with the staple-former 11 via a first guide arrangement 30 and a second guide arrangement 31, whose directions are indicated by the double arrow D, whose direction is in agreement with the direction of the double arrow A, so that the crown-forming part can thus move in the direction indicated by the double arrow A.

On its side facing the stamping surface 29, the crown-forming part is connected with an elastic element 32, also referred to as a take-up means or device, and which is exemplarily depicted in the Figures as a leaf spring 33 bent into a hairpin shape. The leaf spring 33 is, at its opposite end 34 from the crown-forming part, fixedly connected to the base part 22. This fixed connection can be realized by welding, soldering, riveting or in any other way known to one skilled in the art that offers the necessary strength. The leaf spring 33 is inserted in a gap or hole 35 realized in the base part 22, but it will be apparent to one skilled in the art that the leaf spring can be arranged so that it extends to the left in FIG. 4 rather than to the right, as is now shown, meaning that the base part need not be provided with the hole 35.

Figure 5:
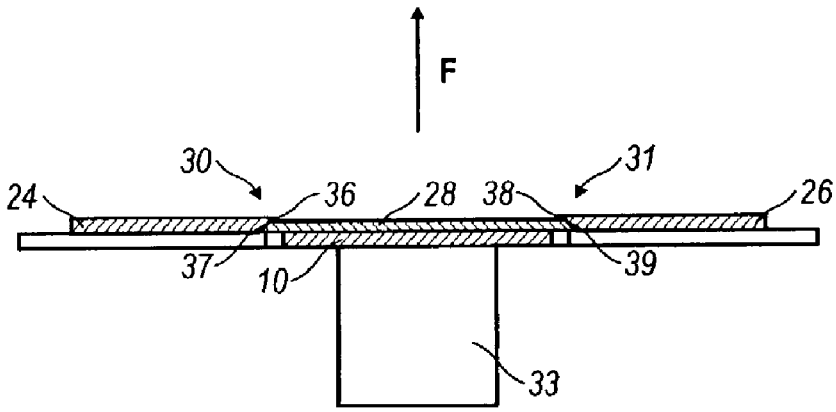
FIG. 5 is a cross-section view taken along the line A—A shown in FIG. 3.

FIG. 5 shows the connection of the crown-forming part 28 with the staple-former 11. As is shown, the crown-forming part 28 is in abutment with the driver blade 10. The figure further shows that the guide arrangement 30 exhibits a first sliding surface 36 arranged on the first leg-bending part 24. A second sliding surface 37 is arranged on the crown-forming part 28 and the sliding surfaces are in sliding contact with one another. The guide arrangement 31 exhibits a third sliding surface 38 on the second leg-bending part 26 and a fourth sliding surface 39 arranged on the crown-forming part 28; these sliding surfaces are also in sliding contact with one another. Because the surfaces 36 and 38 are inclined toward one another in the manner shown in FIG. 5, while the surfaces 37 and 39 are similarly inclined toward one another, it is ensured that the crown-forming part 28 cannot be separated from the driver blade 10 in the direction indicated by the arrow F, thus guarantying that the crown-forming part will be ensured a specified path of motion between the guide arrangements 30 and 31, in abutment with the driver blade 10.

The invention will now be described with reference to FIGS. 1–9 by describing a stapling cycle. When a workpiece 16 is to be stapled, it is placed on the staple anvil 5, at which point the stapler 1 is in its starting position, which is shown in FIG. 1. The positions of the staple-former 11 and the driver blade 10 are shown in FIG. 3. In this position the feed device 6 has advanced the staple band 9 onto the bending die to a position such that a staple blank 8 is situated beneath the staple-former at the same time as a blank that has been formed into staple shape 17 has been advanced to a position in front of the bending die 15, as is most clearly shown in FIGS. 3 and 4.

Figure 6:
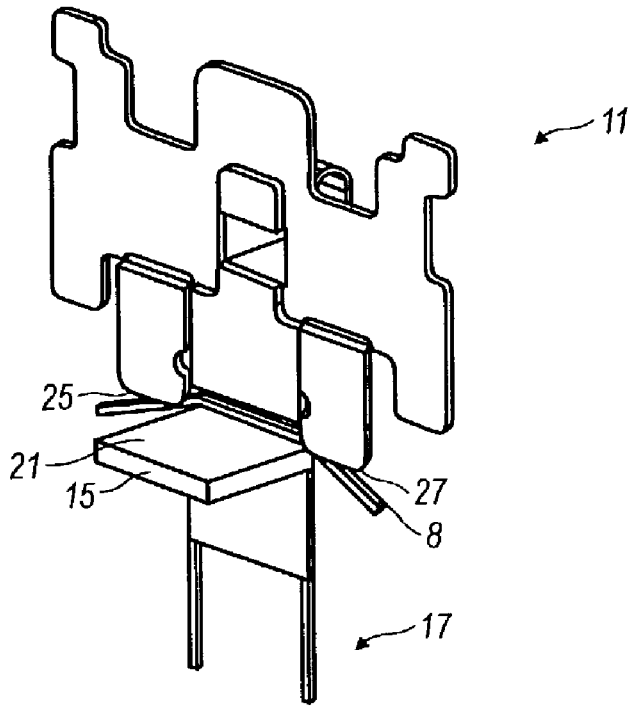
FIG. 6 is a perspective view corresponding to FIG. 3, in which bending of the staple blank has begun.
Figure 7:
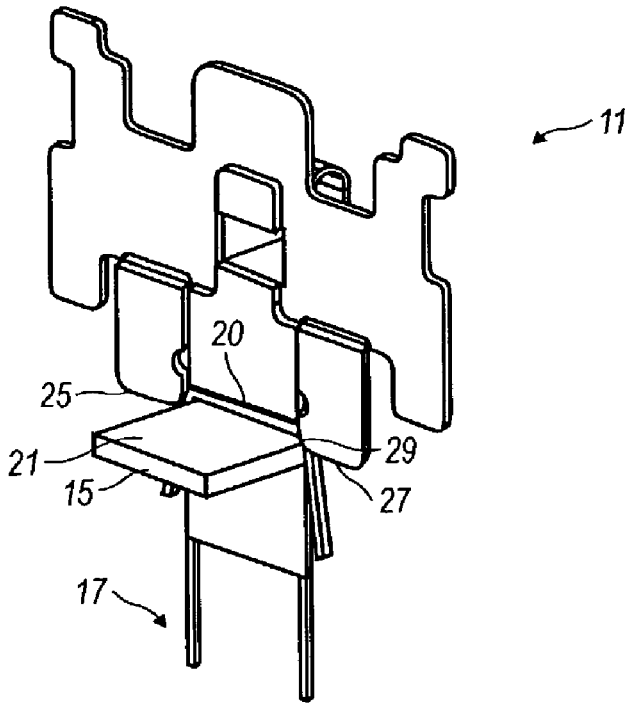
FIG. 7 is a perspective view corresponding to FIG. 3, but in which the staple-former has been moved an additional distance relative to FIG. 6.
Figure 8:
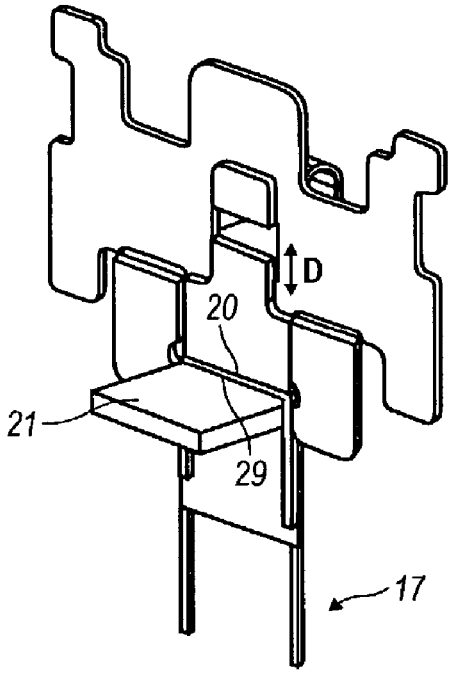
FIG. 8 is a perspective view showing s the staple-former in the position in which the staple blank has been fully bent.

The drive device 12, 13, 14 provides an exemplary embodiment of what is referred to herein as a drive means, an arrangement which drives the stapler head 3 downward in the direction indicated by the double arrow A and into abutment with the workpiece 16, whereupon the stapler head comes into contact with the feed device 6. The staple-former 11 and the driver blade 10 remain in the positions shown in FIG. 3 during this time. The drive device 12, 13, 14 thereafter continues driving the staple-former 11 downward in the direction of the double arrow A. In the course of this downward motion, the bending surfaces 24 and 26 strike the staple blank, which is bent over the bending die 15 and as is depicted in FIG. 6. The driver blade simultaneously drives the staple 17 downward into the workpiece 16; but this is not shown in FIG. 6. The downward motion continues thereafter through the position shown in FIG. 7 and, in this position, the staple blank 8 has been bent further and the stamping surface 29 has come into contact with the crown portion 20 of the staple blank 8. The downward motion is completed once the staple-former reaches the position shown in FIG. 8 and, in this position, the staple-former has been driven far enough downward that the stamping surface 29 presses the crown portion 20 of the staple blank against the support surface 21 of the bending die, whereupon the staple blank is formed into staple shape.

Figure 9:
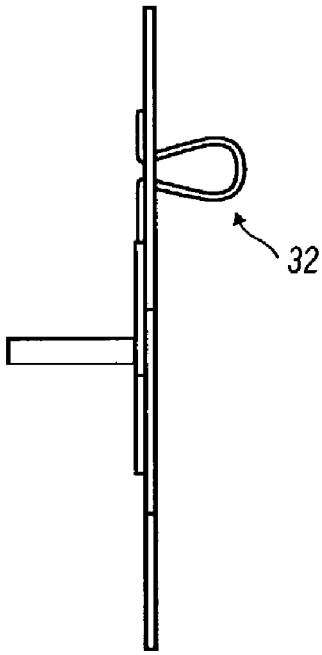
FIG. 9 is a side elevational view of the arrangement shown in FIG. 8.

In this position, the crown-forming part 28 has moved in opposition to the force from the elastic element 32 and upwards relative to the base part 21 in the direction of the double arrow D, thus placing the elastic element 32 under tension as shown in FIG. 9. In this position the driver blade 10 has driven the staple 17 completely into the work piece 16. The drive device 11, 12, 13 is thereafter reversed in a manner known to one skilled in the art, and the staple-former and stapler head resume their positions as shown in FIG. 3 and FIG. 1, respectively, and the tensioned elastic element returns the crown-forming part 28 to the position shown in FIG. 3. During this return motion, the feed device 6 advances the staple band one step forward, whereupon a new stapling sequence can be carried out. The elastic element is designed so as to ensure that the stamping surface 29 presses the staple crown 20 against the support surface 21 with sufficient force, and that this force must be varied depending on the properties of the staple material.

In the foregoing description, the staple shape has been presented as a staple with two substantially parallel legs and an intermediate straight crown portion. It will be obvious to one skilled in the art that the straight crown portion can consist of an arched portion and that, in such a case, the bending die and stamping surface will be realized in arched form. Furthermore, the elastic element has been presented as a hairpin-shaped leaf spring, but it will also be obvious to one skilled in the art that the elastic element may consist of a helical spring whose two ends are secured to the staple-former and the crown-forming part, respectively.

What is claimed is:

1. A staple forming device for bending staple blanks into a shape suitable for being driven into an article including a plurality of components for securing those components together, said staple forming device comprising:

a staple forming arrangement having a main body portion, including at least one leg-bending portion extending in a substantially downward direction, and a staple crown-forming portion, said main body portion and said staple crown-forming portion being reciprocatingly interconnected, whereby said staple crown-forming portion reciprocates relative to said main body portion;

an elastic element interconnected between said main body portion and said staple crown-forming portion, said elastic element biasing said staple crown-forming portion away from said main body portion and permitting said staple crown-forming portion to yield in a substantially upward direction and toward said main body portion during staple blank bending.

2. The staple forming device as recited in claim 1, further comprising:

said staple crown-forming portion secured in at least one guide arrangement to said main body portion and configured for reciprocation therein.

3. The staple forming device as recited in claim 1, further comprising:

a gap space provided between said main body portion and said staple crown-forming portion, said gap space configured to accommodate reciprocating motion between said staple crown-forming portion and said main body portion.

4. The staple forming device as recited in claim 1, further comprising:

a gap space provided between said main body portion and said staple crown-forming portion, said gap space configured to accommodate reciprocating motion between said staple crown-forming portion and said main body portion; and said elastic element interconnected across said gap space for biasing said staple crown-forming portion away from said main body portion.

5. The staple forming device as recited in claim 1, further comprising:

a driver blade interconnected with said main body portion of said staple forming arrangement.

6. The staple forming device as recited in claim 1, further comprising:

a driver blade integrally formed with said main body portion of said staple forming arrangement.

7. The staple forming device as recited in claim 1, further comprising:

a driver blade interconnected with said main body portion of said staple forming arrangement; and said staple crown-forming portion being adjacently positioned to said driver blade and arranged for reciprocation relative thereto.

8. The staple forming device as recited in claim 1, further comprising:

a driver blade interconnected with said main body portion of said staple forming arrangement; and said staple crown-forming portion abuttingly engaged with said driver blade and arranged for reciprocation relative thereto.

9. The staple forming device as recited in claim 1, further comprising:

a driver blade interconnected with said main body portion of said staple forming arrangement, said driver blade and said main body portion being of sheet construction; and said driver blade being located substantially on a common plane with said main body portion.

10. The staple forming device as recited in claim 1, wherein said at least one leg-bending portion positioned along side said staple crown-forming portion.

11. The staple forming device as recited in claim 1, further comprising:

two leg-bending portions, one each positioned along either of two lateral sides of said staple crown-forming portion.

12. The staple forming device as recited in claim 1, further comprising:

said elastic element being at least partially hairpin shaped.

13. The staple forming device as recited in claim 1, further comprising:

said elastic element being a leaf spring.

14. A staple forming device for bending staple blanks into a shape suitable for being driven into an article including a plurality of components for securing those components together, said staple forming device comprising:

a staple forming arrangement having a main body portion, that includes at least one leg-bending portion, interconnected with a staple crown-forming portion by a take-up device configured to permit reciprocation of said staple crown-forming portion relative to said main body portion; and said take up device including a biasing means for applying an outwardly directed force between said staple crown-forming portion and said main body portion, said biasing means having sufficiently high biasing strength for maintaining said staple crown-forming portion in an extended staple bending position against the resistance of a staple blank being bent over a bending die.

15. The staple forming device as recited in claim 14, further comprising:

said biasing means having sufficiently low biasing strength for permitting said crown-forming portion to retract toward said main body portion after a staple blank has been bent into a staple shape and as said main body portion continues to travel toward the bending die.

16. A staple forming device for a stapler of the type in which staples are driven by a driver blade into a workpiece and which includes a staple magazine in which are stored a longitudinal band of interconnected staple blanks that are advanced by a feed device onto a bending die, the bending die having an upper support surface over which the staple blanks are bent into a staple shape that exhibits a first and a second leg with an intermediate crown portion, said staple forming device comprising:

a first leg-bending portion and a second leg-bending portion with an intermediate crown-forming portion having a stamping surface;

a drive means for driving said stamping surface from a starting position of a staple-forming motion in which the staple forming device is brought against the bending die and whereupon said first and second leg-bending parts bend the staple blank into a staple shape over the bending die, said drive means further configured for continuing the staple forming motion so that the stamping surface advances a distance such that the stamping surface of the crown-forming part presses the crown portion of the staple blank against the support surface, whereupon the staple forming device is reciprocated by said drive means to said starting position and a bent staple is fed forward into an operative position with respect to a driver blade; and said crown-forming portion being displaceably interconnected by an elastic element to a main body portion including said first leg-bending portion and said second leg-bending portion of the staple forming device and arranged for reciprocation of said crown-forming portion relative to said main body portion.

17. A staple forming device as recited in claim 16, further comprising:

said elastic element is provided in the form of a hairpin-shaped leaf spring.

18. A staple forming device as recited in claim 16, further comprising:

said crown-forming portion being secured to said main body portion of said staple forming device by a first and second guide arrangement, each of which are configured for facilitating reciprocation of said crown-forming portion relative to said main body portion of said staple forming device.

19. A staple forming device as recited in claim 16, further comprising:

an integrated driver blade.

20. A staple forming device for bending staple blanks into a shape suitable for being driven into an article including a plurality of components for securing those components together, said staple forming device comprising:

a staple forming arrangement having a main body portion, including at least one leg-bending portion extending in a substantially downward direction, and a staple crown-forming portion, said main body portion being connected in a reciprocating manner to said staple crown-forming portion whereby said main body portion and said staple crown-forming portion are in slidable relation;

an elastic element interconnected between said main body portion and said staple crown-forming portion, said elastic element biasing said staple crown-forming portion away from said main body portion and permitting said staple crown-forming portion to yield in a substantially upward direction and toward said main body portion during staple blank bending.

* * * * *